US010507496B2

(12) United States Patent
Wibby

(10) Patent No.: US 10,507,496 B2
(45) Date of Patent: Dec. 17, 2019

(54) CLEANING APPARATUS HAVING ADJUSTABLE EXPOSED SURFACE AREA

(71) Applicant: Clean Sponge, LLC, Carbondale, CO (US)

(72) Inventor: Adam Litchfield Wibby, Carbondale, CO (US)

(73) Assignee: Clean Sponge, LLC, Carbondale, CO (US)

( * ) Notice: Subject to any disclaimer, the term of this patent is extended or adjusted under 35 U.S.C. 154(b) by 544 days.

(21) Appl. No.: 15/179,577

(22) Filed: Jun. 10, 2016

(65) Prior Publication Data

US 2016/0361738 A1 Dec. 15, 2016

Related U.S. Application Data

(60) Provisional application No. 62/174,071, filed on Jun. 11, 2015.

(51) Int. Cl.

| | |
|---|---|
| ***B08B 1/00*** | (2006.01) |
| ***A47L 13/16*** | (2006.01) |
| *A47L 1/15* | (2006.01) |

(52) U.S. Cl.

CPC ..... *B08B 1/006* (2013.01); *A47L 13/16* (2013.01); *A47L 1/15* (2013.01)

(58) Field of Classification Search

None

See application file for complete search history.

(56) References Cited

U.S. PATENT DOCUMENTS

| | | | |
|---|---|---|---|
| 1,292,982 | A | 1/1919 | Wolf |
| 1,681,031 | A | 8/1928 | Forbis |
| 1,905,163 | A | 4/1933 | Farquhar |
| 2,006,708 | A | 7/1935 | Benedict |
| 2,079,600 | A | 5/1937 | Brooks |
| 2,119,895 | A | 6/1938 | Sutton |

(Continued)

FOREIGN PATENT DOCUMENTS

| | | |
|---|---|---|
| EP | 0845980 B1 | 11/2002 |

OTHER PUBLICATIONS

U.S. Appl. No. 62/174,071, filed Jun. 11, 2015.

*Primary Examiner* — Mikhail Kornakov

*Assistant Examiner* — Ryan L. Coleman

(74) *Attorney, Agent, or Firm* — Craig R. Miles; CR Miles P.C.

(57) ABSTRACT

Disclosed herein are embodiments of a cleaning apparatus having an adjustable exposed surface area, the cleaning apparatus including: a flexible body with a predetermined flexible body area, the flexible body having a flexible body collapsible portion; and a panel with a predetermined panel area which is lesser than the predetermined flexible body area, the panel coupled to the flexible body to form a receptacle sized to receive the flexible body collapsible portion when the flexible body collapsible portion disposes in a collapsed condition; wherein the cleaning apparatus is adjustable between a first configuration, in which the cleaning apparatus has a lesser exposed surface area, and a second configuration, in which the cleaning apparatus has a greater exposed surface area; and wherein the first configuration is generated by removably inserting the flexible body collapsible portion disposed in the collapsed condition into the receptacle.

17 Claims, 15 Drawing Sheets

(56) References Cited

U.S. PATENT DOCUMENTS

| | | | | |
|---|---|---|---|---|
| 2,156,940 | A | 5/1939 | Graham | |
| 2,669,737 | A | 2/1954 | Evans | |
| 2,817,865 | A | 12/1957 | Aroili | |
| 2,958,885 | A | 11/1960 | Donney | |
| 3,175,331 | A | 3/1965 | Klein | |
| 4,228,834 | A | 10/1980 | Desnick | |
| 4,254,530 | A | 3/1981 | Lambert | |
| 5,022,517 | A | 6/1991 | Benitez | |
| 5,326,610 | A | 7/1994 | Moss | |
| 5,462,378 | A | 10/1995 | Webb | |
| 5,618,110 | A * | 4/1997 | Sullivan | A45C 3/10<br>224/153 |
| 6,042,288 | A | 3/2000 | Rattinger et al. | |
| 7,013,494 | B2 | 3/2006 | Wilkins | |
| 2007/0065224 | A1 | 3/2007 | Shaw | |
| 2015/0173580 | A1 * | 6/2015 | Greene | A47K 10/02<br>15/209.1 |

* cited by examiner

1/8

1/8

1/8

1/8

1/9

1/9

CLEANING APPARATUS HAVING ADJUSTABLE EXPOSED SURFACE AREA

This United States Non-Provisional Patent Application claims the benefit of U.S. Provisional Patent Application No. 62/174,071, filed Jun. 11, 2015, hereby incorporated by reference herein.

I. SUMMARY OF THE INVENTION

A broad object of a particular embodiment of the invention can be to provide a cleaning apparatus having an adjustable exposed surface area, and methods of making and using such a cleaning apparatus, the cleaning apparatus including: a flexible body with a predetermined flexible body area, the flexible body having a flexible body collapsible portion; and a panel with a predetermined panel area which is lesser than the predetermined flexible body area, the panel coupled to the flexible body to form a receptacle sized to receive the flexible body collapsible portion when the flexible body collapsible portion disposes in a collapsed condition; wherein the cleaning apparatus is adjustable between a first configuration, in which the cleaning apparatus has a lesser exposed surface area, and a second configuration, in which the cleaning apparatus has a greater exposed surface area; and wherein the first configuration is generated by removably inserting the flexible body collapsible portion disposed in the collapsed condition into the receptacle.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1A:
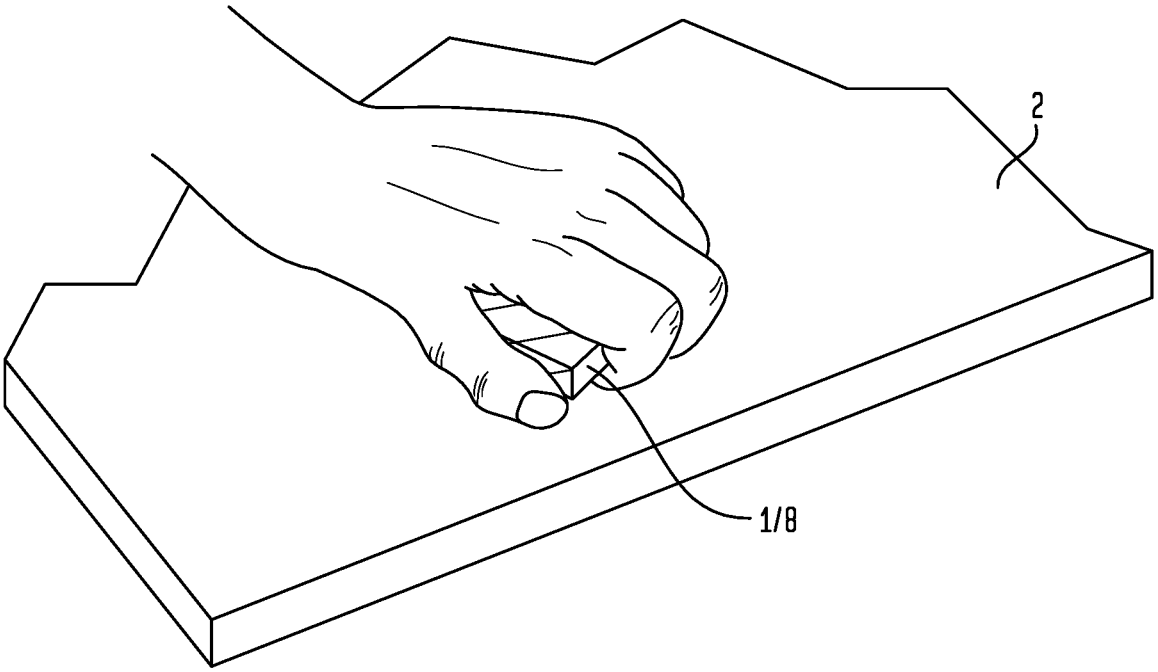
FIG. 1A is an illustration of a method of using a particular embodiment of the cleaning apparatus configured in a first configuration to clean a cleanable surface.

Now referring primarily to FIG. 1A, which illustrates a method of using a particular embodiment of a cleaning apparatus (1) having an adjustable exposed surface area to clean a cleanable surface (2), whereby the method includes obtaining a cleaning apparatus (1) comprising: a flexible body (3) with a predetermined flexible body area (3A), the flexible body (3) having a flexible body collapsible portion (4); and a panel (5) with a predetermined panel area (5A) which is lesser than the predetermined flexible body area (3A), the panel (5) coupled to the flexible body (3) to form a receptacle (6) sized to receive the flexible body collapsible portion (4) when the flexible body collapsible portion (4) disposes in a collapsed condition (7).

For the purposes of the present invention, the term "flexible" means capable of flexing or bending without breaking, or capable of being flexed or bent without breaking.

The method further includes disposing the flexible body collapsible portion (4) in the collapsed condition (7); and removably inserting the flexible body collapsible portion (4) disposed in the collapsed condition (7) into the receptacle (6) to generate a first configuration (8), in which the cleaning apparatus (1) has a lesser exposed surface area relative to a second configuration (9), in which the cleaning apparatus (1) has a greater exposed surface area. Following, the cleaning apparatus (1) configured in the first configuration (8) can be used to clean, for example to clean the cleanable surface (2), whereby the cleanable surface (2) can be cleaned by direct contact or engagement with the exposed surface area of the cleaning apparatus (1).

Figure 1B:
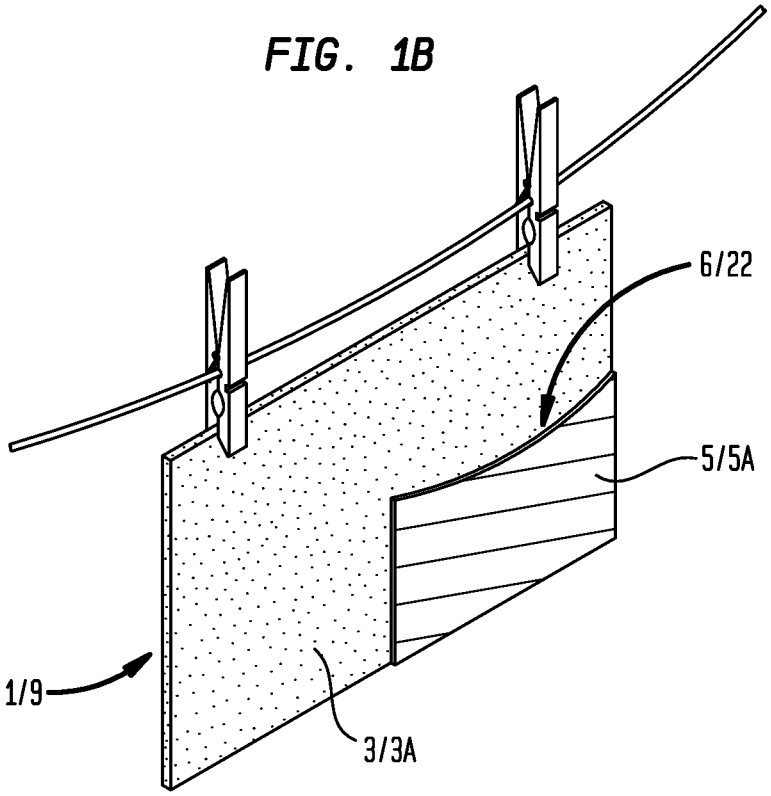
FIG. 1B is an illustration of a method of using a particular embodiment of the cleaning apparatus configured in a second configuration.

Now referring primarily to FIG. 1B, the method can, but need not necessarily, further include removing the flexible body collapsible portion (4) from within the receptacle (6) to generate the second configuration (9), in which the cleaning apparatus (1) has a greater exposed surface area.

The second configuration (9) of the cleaning apparatus (1) may be useful to facilitate cleaning, for example to facilitate cleaning of a cleanable surface (2) which requires a cleaning apparatus (1) having a greater exposed surface area.

Additionally, the second configuration (9) of the cleaning apparatus (1) may be useful to facilitate washing of the cleaning apparatus (1). As to particular embodiments, the cleaning apparatus (1) in the second configuration (9) can be hand-washed or washed by hand. As to other particular embodiments, the cleaning apparatus (1) in the second configuration (9) can be washed via a washing machine, for example by disposing the cleaning apparatus (1) in the washing machine and subsequently operating the washing machine to wash the cleaning apparatus (1).

Regarding washing of the cleaning apparatus (1), by disposing the cleaning apparatus (1) in the second configuration (9), it may be possible to wash away or remove a greater amount of debris collected by the cleaning apparatus (1) than would be possible (i) if the cleaning apparatus (1) was disposed in the first configuration (8), or (ii) in comparison to a conventional sponge, which generally cannot be configured to have an increased exposed surface area for washing the sponge.

Yet additionally, the second configuration (9) of the cleaning apparatus (1) may be useful to facilitate drying of the cleaning apparatus (1). As to particular embodiments, the cleaning apparatus (1) in the second configuration (9) can be air-dried or dried via exposure to air at ambient temperature. As to other particular embodiments, the cleaning apparatus (1) in the second configuration (9) can be dried via a clothes dryer, for example by disposing the cleaning apparatus (1) in the clothes dryer and subsequently operating the clothes dryer to dry the cleaning apparatus (1).

Regarding drying of the cleaning apparatus (1), by disposing the cleaning apparatus (1) in the second configuration (9), it may be possible to dry the cleaning apparatus (1) in a lesser amount of time than would be possible (i) if the cleaning apparatus (1) was disposed in the first configuration (8), or (ii) in comparison to a conventional sponge, which generally cannot be configured to have an increased exposed surface area for drying the sponge. For example, it may be possible to dry the cleaning apparatus (1) in the second configuration (9) about six times faster than the amount of time it would take to dry a conventional sponge.

Subsequent to drying, the method can, but need not necessarily, further include re-using the cleaning apparatus (1), for example by again disposing the flexible body collapsible portion (4) in the collapsed condition (7); and again removably inserting the flexible body collapsible portion (4) disposed in the collapsed condition (7) into the receptacle (6) to generate the first configuration (8). Following, the cleaning apparatus (1) configured in the first configuration (8) can again be used to clean, for example to clean a cleanable surface (2), as described above.

Now referring primarily to FIG. 2A through FIG. 6B, the cleaning apparatus (1) having an adjustable exposed surface area includes a flexible body (3) with a predetermined flexible body area (3A) defined by a flexible body peripheral edge (10) or outer boundary. Further, the flexible body (3) has opposing flexible body first and second faces (11)(12), each of which extends to the flexible body peripheral edge (10).

The flexible body peripheral edge (10) can define any of a numerous and wide variety of configurations of varying dimensions, depending upon the application. As shown in the examples of the Figures, the flexible body peripheral edge (10) can be generally rectangular; however the invention need not be so limited. As additional non-limiting examples, the flexible body peripheral edge (10) can be configured as a circle, an oval, an ellipse, a triangle, a square, a trapezoid, a polygon, a freeform configuration, or the like, or combinations thereof, depending upon the desired shape of the cleaning apparatus (1).

Figure 2A:
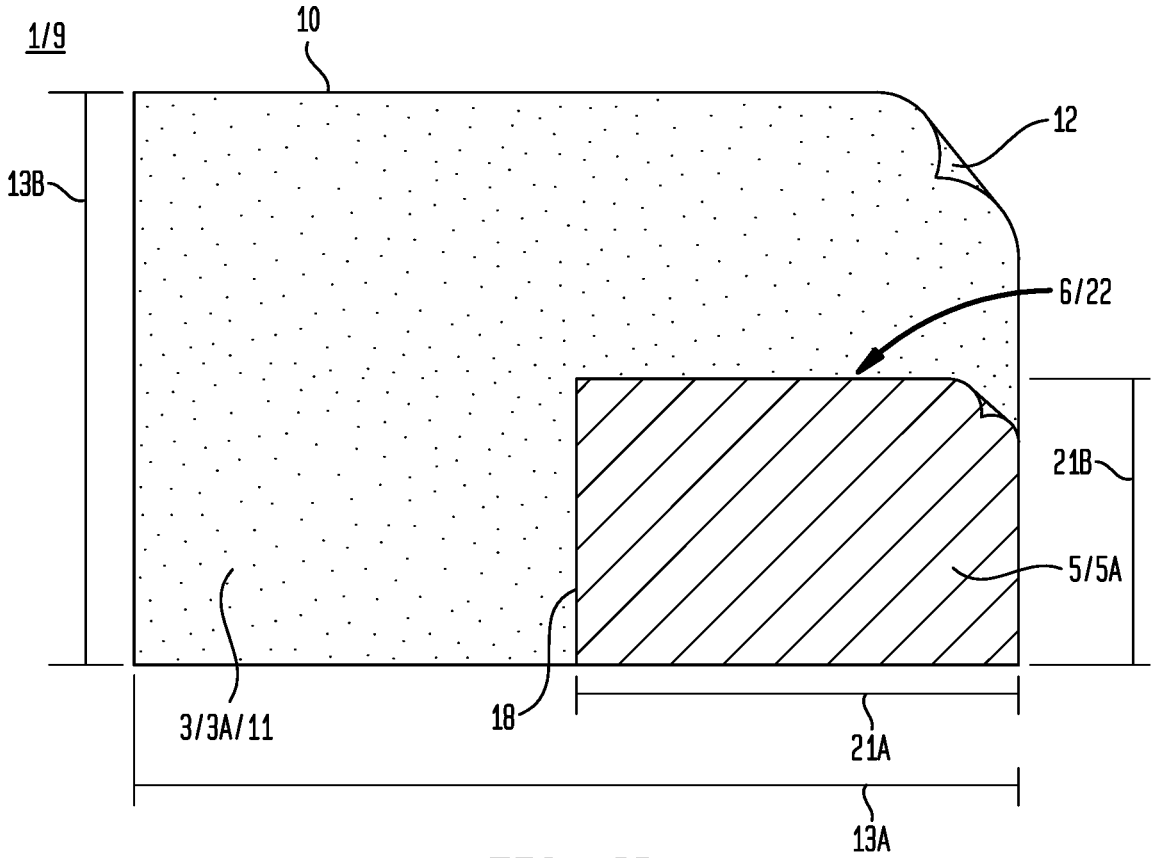
FIG. 2A is a front view of a particular embodiment of the cleaning apparatus having one panel coupled to a flexible body first face of a flexible body, whereby the cleaning apparatus is configured in a second configuration.
Figure 2B:
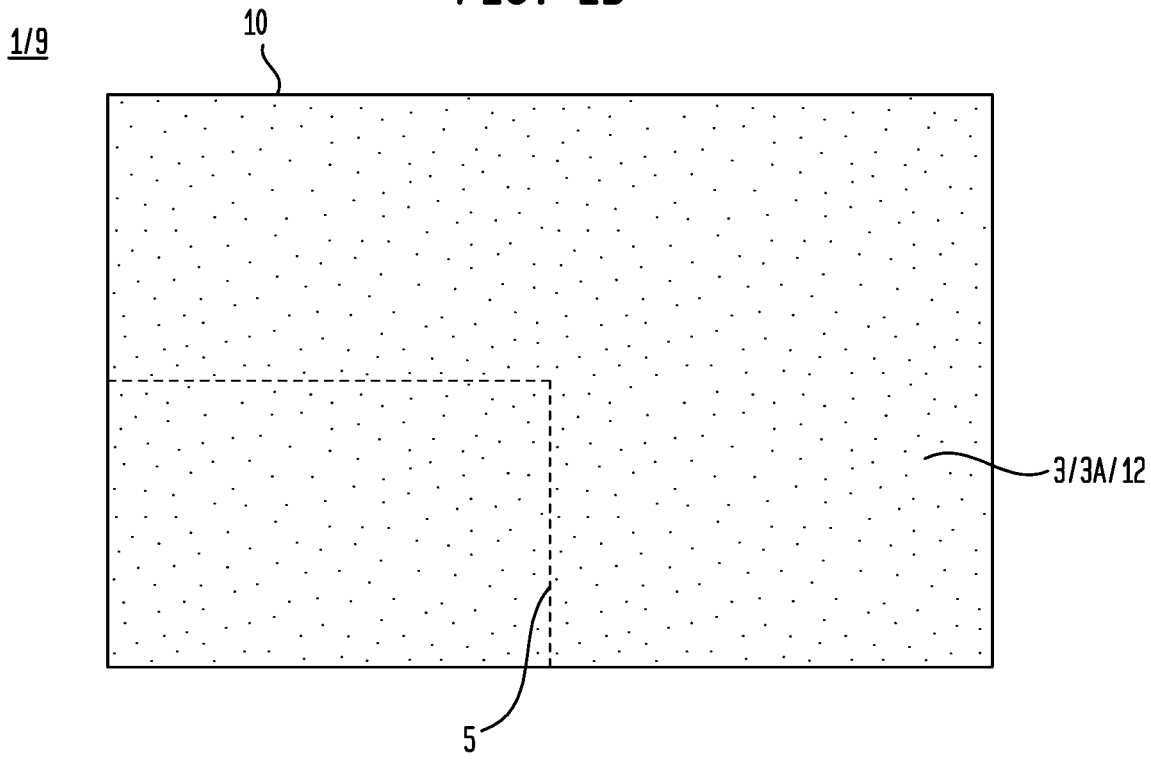
FIG. 2B is a rear view of the particular embodiment of the cleaning apparatus shown in FIG. 2A.
Figure 2C:
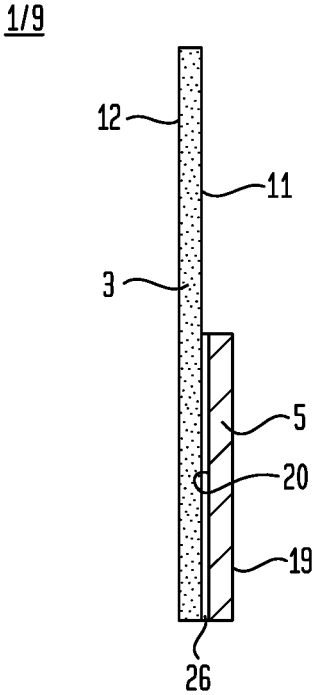
FIG. 2C is a first side view of the particular embodiment of the cleaning apparatus shown in FIG. 2A.
Figure 2D:
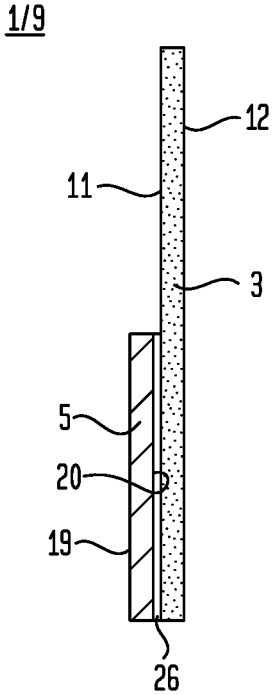
FIG. 2D is a second side view of the particular embodiment of the cleaning apparatus shown in FIG. 2A.
Figure 2E:
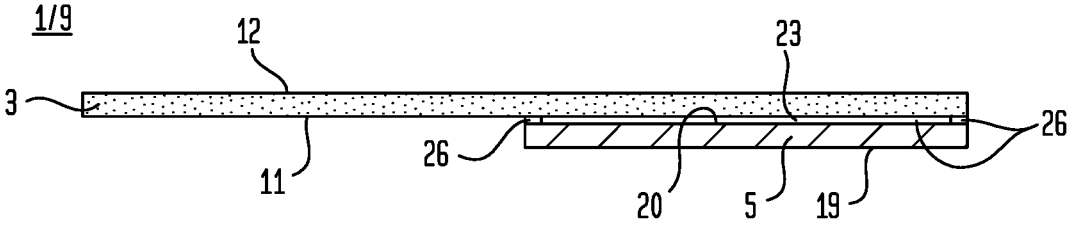
FIG. 2E is a first end view of the particular embodiment of the cleaning apparatus shown in FIG. 2A.
Figure 2F:
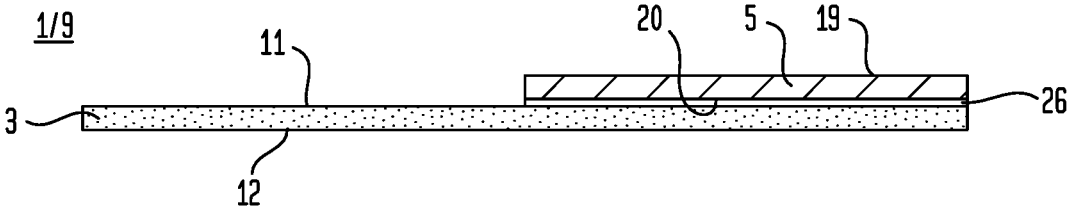
FIG. 2F is a second end view of the particular embodiment of the cleaning apparatus shown in FIG. 2A.

Now referring primarily to FIG. 2A, the flexible body (3) can have a predetermined flexible body length (13A) and a predetermined flexible body width (13B) which together provide the predetermined flexible body area (3A). As but one non-limiting example, the predetermined flexible body length (13A) can be about 32 centimeters (about 12.5 inches) and the predetermined flexible body width (13B) can be about 20 centimeters (about 8 inches), thereby providing a flexible body (3) with a generally rectangular flexible body peripheral edge (10). Correspondingly, the predetermined flexible body area (3A) can be about 640 square centimeters (about 100 square inches). However, the invention need not be limited to these dimensions.

Now referring primarily to FIG. 2A through FIG. 4, as to particular embodiments, the flexible body (3) can be formed as a one-piece flexible body (3). Accordingly, the flexible body first and second faces (11)(12) can be similar, being formed from the same material.

Now referring primarily to FIG. 5A through FIG. 5J, as to other particular embodiments, the flexible body (3) can be formed from a plurality of flexible body layers (15)(16) coupled, directly coupled, or connected to one another to provide the flexible body (3). As but one illustrative example, the flexible body first face (11) can be comprised of a flexible body first layer (15) and the flexible body second face (12) can be comprised of a flexible body second layer (16). Accordingly, the flexible body first and second layers (15)(16) can be in overlaying engagement with one another when providing the flexible body (3).

The flexible body first layer (15) can be formed from a material having a lesser abrasiveness (or a lesser tendency to abrade or cause abrasion) in relation to the flexible body second layer (16), which can be formed from a material having a greater abrasiveness (or a greater tendency to abrade or cause abrasion).

Figure 5A:
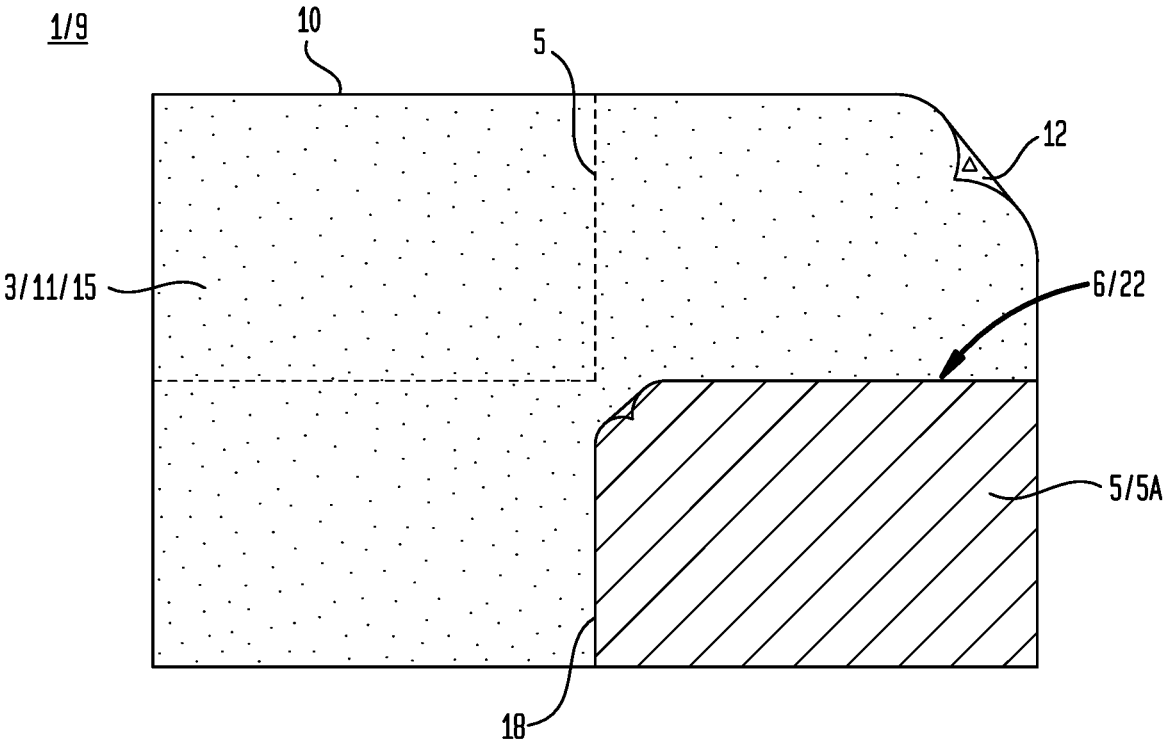
FIG. 5A is a front view of a particular embodiment of the cleaning apparatus having a panel coupled to each one of flexible body first and second faces of a flexible body, whereby the cleaning apparatus is configured in a second configuration.
Figure 5B:
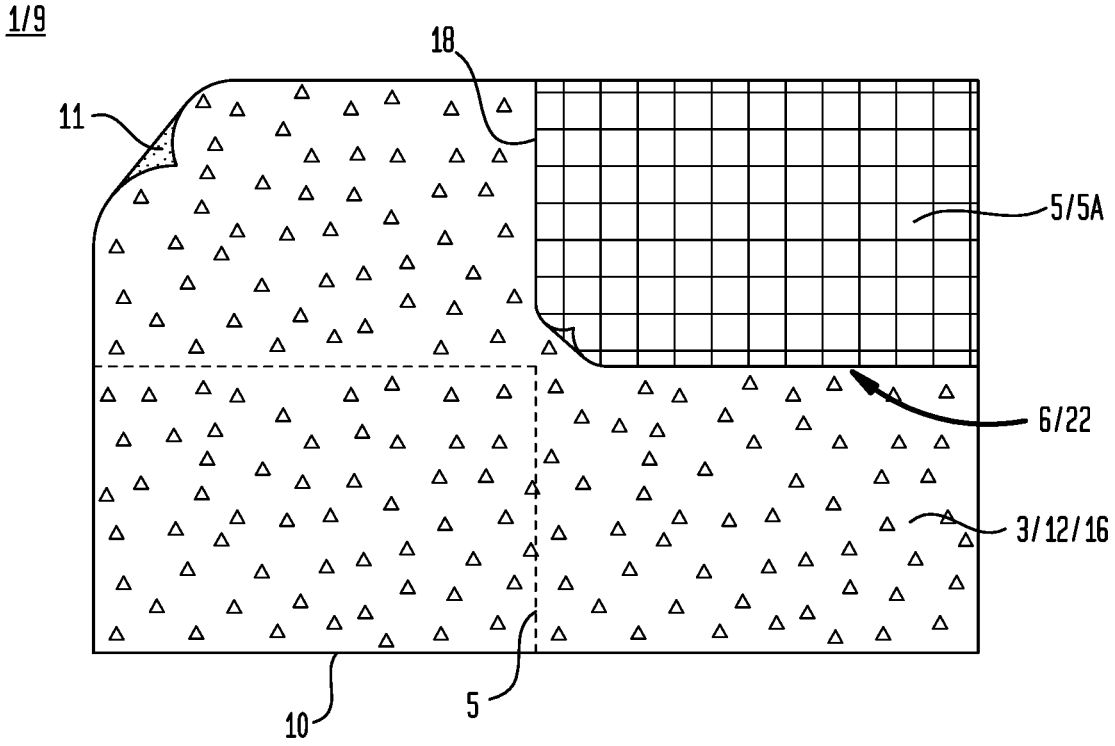
FIG. 5B is a rear view of the particular embodiment of the cleaning apparatus shown in FIG. 5A.
Figure 5C:
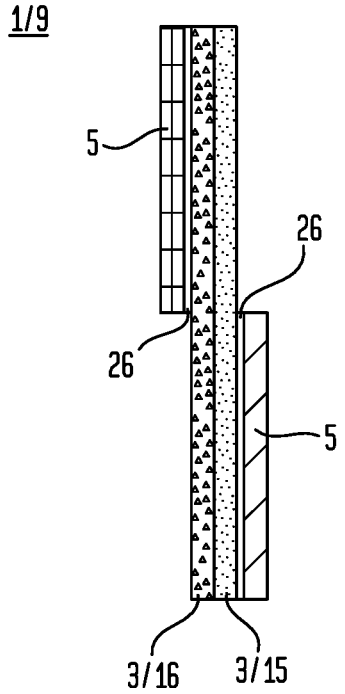
FIG. 5C is a first side view of the particular embodiment of the cleaning apparatus shown in FIG. 5A.
Figure 5D:
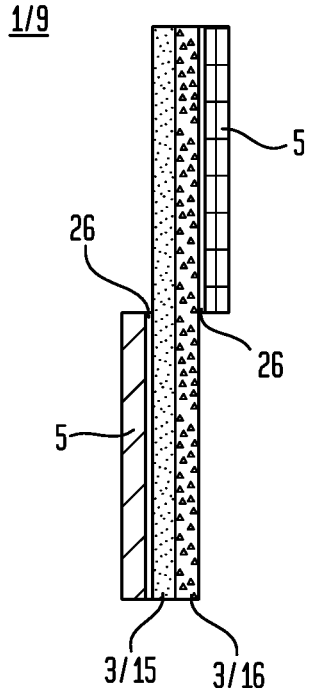
FIG. 5D is a second side view of the particular embodiment of the cleaning apparatus shown in FIG. 5A.
Figure 5E:
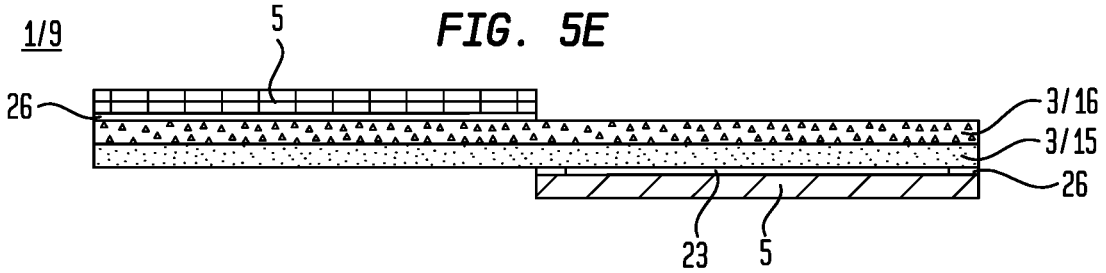
FIG. 5E is a first end view of the particular embodiment of the cleaning apparatus shown in FIG. 5A.
Figure 5F:
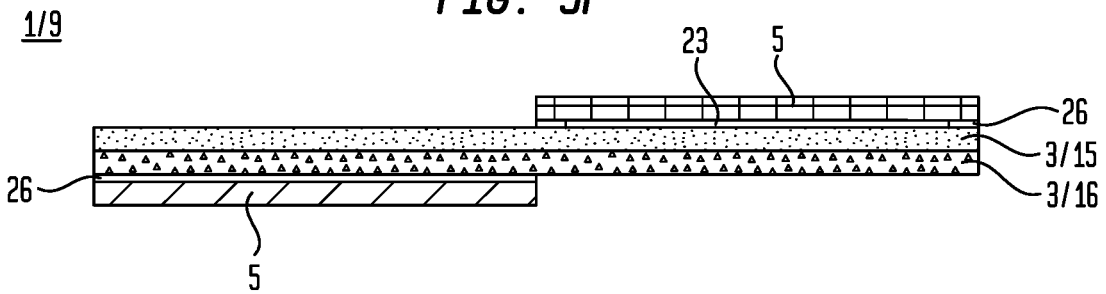
FIG. 5F is a second end view of the particular embodiment of the cleaning apparatus shown in FIG. 5A.
Figure 5G:
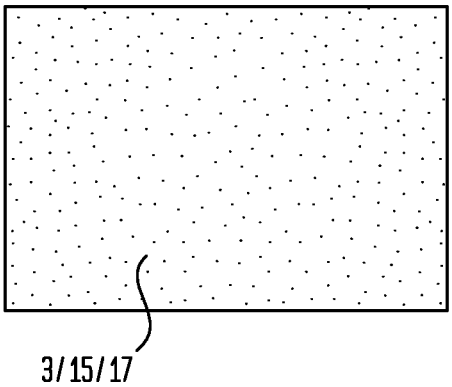
FIG. 5G is a view of a first exposed cleaning surface of the particular embodiment of the cleaning apparatus shown in FIG. 5A through FIG. 5F, whereby the cleaning apparatus is configured in a first configuration.

Correspondingly, the cleaning apparatus (1) can be configured to have a first exposed cleaning surface (17) with lesser abrasiveness by outwardly exposing the flexible body first layer (15) when the first configuration (8) is generated (as shown in the example of FIG. 5G). Conversely, the cleaning apparatus (1) can be configured to have a first exposed cleaning surface (17) with greater abrasiveness by outwardly exposing the flexible body second layer (16) when the first configuration (8) is generated (as shown in the example of FIG. 5I). As such, the cleaning apparatus (1) can be customized, whereby the first exposed cleaning surface (17) can be selected from one of two options, depending upon the abrasiveness desired to clean a particular cleanable surface (2). As to particular embodiments, the first exposed cleaning surface (17) can be a flexible first exposed cleaning surface (17), which may be useful for conforming to the cleanable surface (2) to better clean the cleanable surface (2) versus a rigid or non-flexible first exposed cleaning surface (17).

Now referring primarily to FIG. 8A through FIG. 8C and FIG. 9A through FIG. 9C, the flexible body (3) has a flexible body collapsible portion (4), which when disposed in a collapsed condition (7), can be received within a receptacle (6). The collapsed condition (7) of the flexible body collapsible portion (4) can be achieved by any method of collapsing flexible material and, as non-limiting examples, can include folding, rolling, balling, scrunching, crumpling, crushing, or the like, or combinations thereof, or any method useful for collapsing flexible material.

Again referring primarily to FIG. 8A through FIG. 8C and FIG. 9A through FIG. 9C, the flexible body collapsible portion (4) can include all of the flexible body (3) except for the portion of the flexible body (3) which, together with the panel (5), forms the receptacle (6).

Now referring primarily to FIG. 2A through FIG. 9F, the cleaning apparatus (1) further includes a panel (5) with a predetermined panel area (5A) which is lesser than the predetermined flexible body area (3A), whereby the predetermined panel area (5A) is defined by a panel peripheral edge (18) or outer boundary. Further, the panel (5) has opposing panel first and second faces (19)(20), each of which extends to the panel peripheral edge (18). As to particular embodiments, the panel (5) can be a flexible panel (5).

The panel peripheral edge (18) can define any of a numerous and wide variety of configurations of varying dimensions, depending upon the application. As shown in the examples of the Figures, the panel peripheral edge (18) can be generally rectangular; however the invention need not be so limited. As additional non-limiting examples, the panel peripheral edge (18) can be configured as a circle, an oval, an ellipse, a triangle, a square, a trapezoid, a polygon, a freeform configuration, or the like, or combinations thereof, depending upon the desired shape of the cleaning apparatus (1).

Now referring primarily to FIG. 2A, the panel (5) can have a predetermined panel length (21A) and a predetermined panel width (21B) which together provide the predetermined panel area (5A) which is lesser than the predetermined flexible body area (3A).

As but a first non-limiting example, the predetermined panel length (21A) can be about 20 centimeters (about 7.5 inches) and the predetermined panel width (21B) can be about 10 centimeters (about 4 inches), thereby providing a panel (5) with a generally rectangular panel peripheral edge (18). Correspondingly, the predetermined panel area (5A) can be about 200 square centimeters (about 30 square inches), which may be suitable for coupling to the flexible body (3) of the above non-limiting example, which has a predetermined flexible body area (3A) of about 640 square centimeters (about 100 square inches).

As but a second non-limiting example, the predetermined panel length (21A) can be about 13 centimeters (about 5 inches) and the predetermined panel width (21B) can be about 10 centimeters (about 4 inches), thereby providing a panel (5) with a generally rectangular panel peripheral edge (18). Correspondingly, the predetermined panel area (5A) can be about 130 square centimeters (about 20 square inches), which may be suitable for coupling to the flexible body (3) of the above non-limiting example, which has a predetermined flexible body area (3A) of about 640 square centimeters (about 100 square inches).

Now referring primarily to FIG. 2A through FIG. 9F, the panel (5) couples to the flexible body (3) to form a receptacle (6) sized or configured to receive the flexible body collapsible portion (4) when the flexible body collapsible portion (4) disposes in the collapsed condition (7).

The receptacle (6) has a receptacle opening (22) which communicates with a receptacle interior space (23). Correspondingly, the flexible body collapsible portion (4) disposed in the collapsed condition (7) can be passed through the receptacle opening (22) for receipt within the receptacle interior space (23).

Figure 3A:
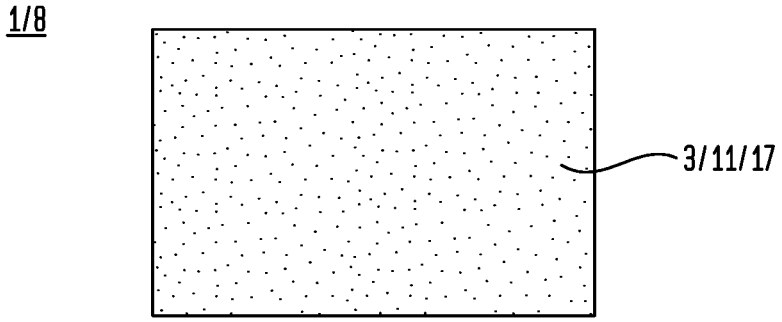
FIG. 3A is a front view of the particular embodiment of the cleaning apparatus shown in FIG. 2A through FIG. 2F, whereby the cleaning apparatus is configured in a first configuration.
Figure 3B:
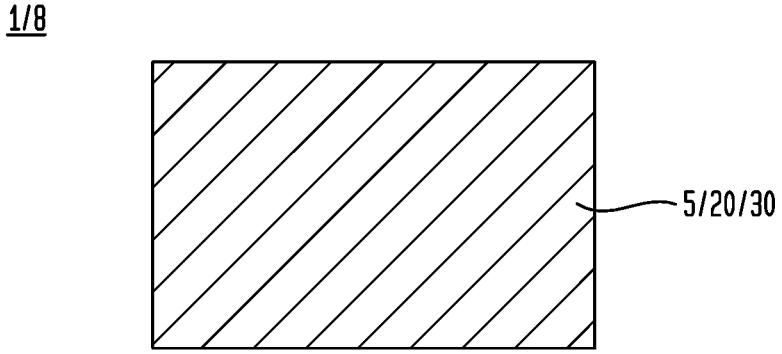
FIG. 3B is a rear view of the particular embodiment of the cleaning apparatus shown in FIG. 2A through FIG. 2F, whereby the cleaning apparatus is configured in a first configuration.
Figure 3C:
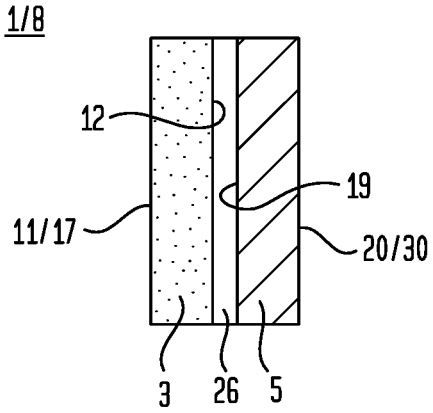
FIG. 3C is a first side view of the particular embodiment of the cleaning apparatus shown in FIG. 2A through FIG. 2F, whereby the cleaning apparatus is configured in a first configuration.
Figure 3D:
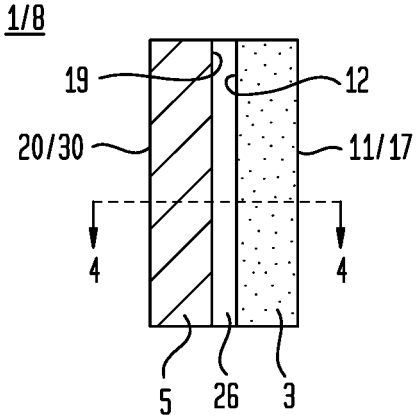
FIG. 3D is a second side view of the particular embodiment of the cleaning apparatus shown in FIG. 2A through FIG. 2F, whereby the cleaning apparatus is configured in a first configuration.
Figure 3E:
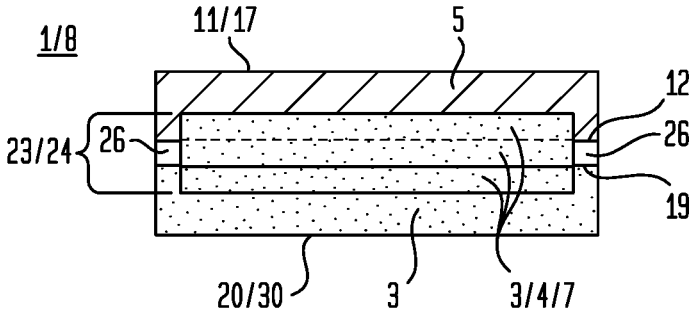
FIG. 3E is a first end view of the particular embodiment of the cleaning apparatus shown in FIG. 2A through FIG. 2F, whereby the cleaning apparatus is configured in a first configuration.
Figure 3F:
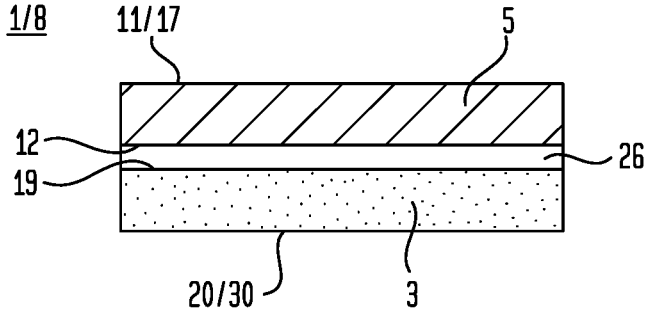
FIG. 3F is a second end view of the particular embodiment of the cleaning apparatus shown in FIG. 2A through FIG. 2F, whereby the cleaning apparatus is configured in a first configuration.
Figure 4:
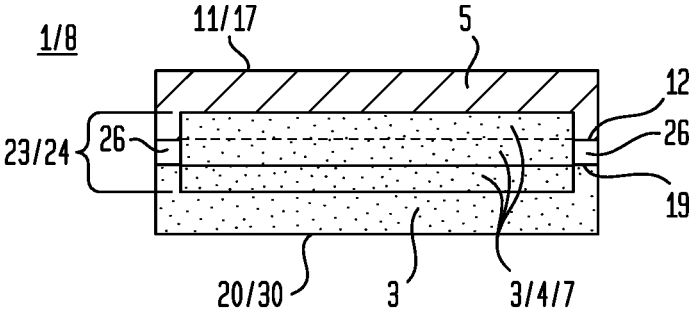
FIG. 4 is a cross-sectional view 4-4 of the particular embodiment of the cleaning apparatus shown in FIG. 3D.

As to particular embodiments whereby the flexible body collapsible portion (4) is disposed in the collapsed condition (7) by folding to provide a plurality of folded layers (24) of the flexible body collapsible portion (4), the size of the receptacle (6) should be sufficient to receive the plurality of folded layers (24). Following, the first configuration (8) of the cleaning apparatus (1) will have a thickness (25) (as shown in the example of FIG. 3C) determined by the combined thicknesses of: the panel (5), the portion of the flexible body (3) to which the panel (5) couples to form the receptacle (6), and the plurality of folded layers (24) received within the receptacle (6). As but one non-limiting example, the first configuration (8) of the cleaning apparatus (1) can have a thickness (25) of about 4 centimeters (about 1.5 inches).

To form the receptacle (6), the panel (5) can be coupled to the flexible body (3) by directly connecting the panel peripheral edge (18) to the flexible body (3) except along the portion of the panel peripheral edge (18) proximate the receptacle opening (22).

As to particular embodiments, the panel (5) can be fixedly coupled to the flexible body (3) by an adherent layer (26). As used herein, the term "adherent layer" broadly encompasses at least one, one or more, or a combination of a wide variety of adhesives or mechanical fasteners. While the illustrative example of the adherent layer (26) shown in the Figures depicts a mechanical fastener configured as stitching, embodiments can have any suitable adherent layer (26) sufficient to fixedly couple the panel (5) to the flexible body (3).

Exemplary adhesives can include, as illustrative examples: non-reactive adhesives including drying adhesives, pressure-sensitive adhesives, contact adhesives, and hot adhesives; reactive adhesives including one-part adhesives and multi-part adhesives; natural adhesives; synthetic adhesives; or the like, or combinations thereof.

Exemplary mechanical fasteners can include, as illustrative examples: annular elements, buckles, buttons, clamps, clips, grommets, hook-and-eye closures, mated hook and loop fasteners, pins, rivets, snap fasteners, staples, stitches, straps, tape, zippers, or the like, or combinations thereof.

Now referring primarily to FIG. 2A, FIG. 5A, FIG. 6A, FIG. 8A, and FIG. 9A, as to particular embodiments, the panel (5) can be fixedly coupled to the flexible body (3) such that a portion of the panel peripheral edge (18) which defines the predetermined panel area (5A) aligns with a portion of the flexible body peripheral edge (10) which defines the predetermined flexible body area (3A).

As but one illustrative example, a particular embodiment of the cleaning apparatus (1) can be configured such that a bottommost panel peripheral edge (18) aligns with a bottommost flexible body peripheral edge (10) (as shown in FIG. 2A, FIG. 5A, FIG. 6A, FIG. 8A, and FIG. 9A).

Figure 6A:
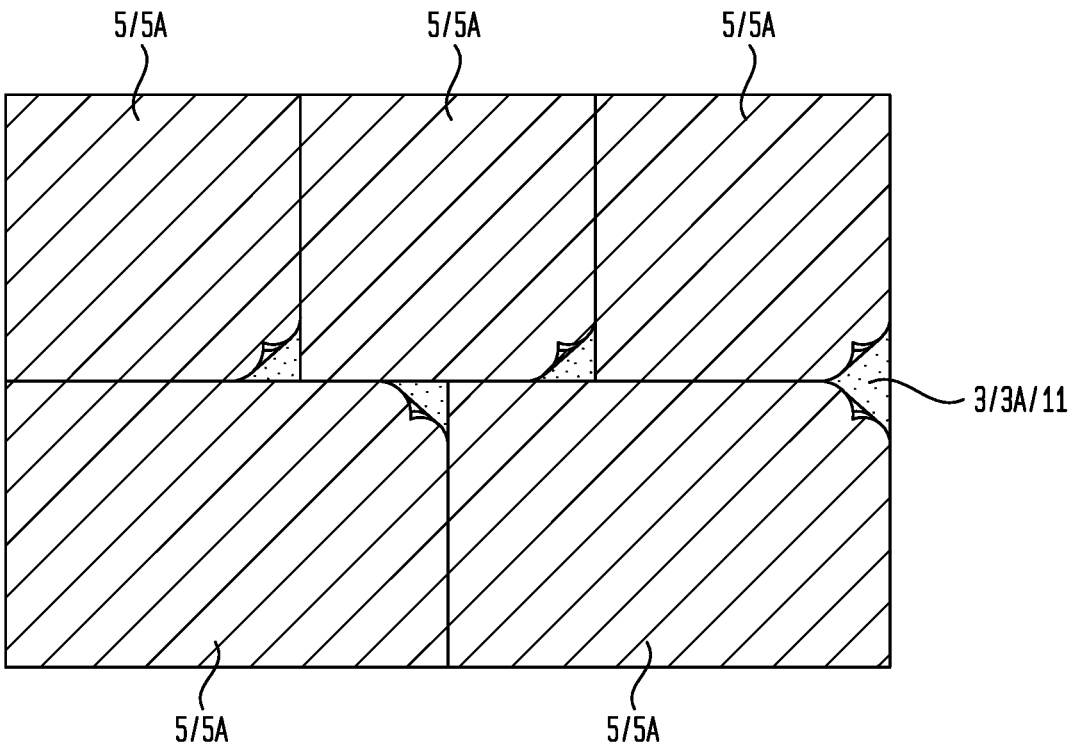
FIG. 6A is a front view of a particular embodiment of the cleaning apparatus having a plurality of panels coupled to a flexible body first face of a flexible body, whereby the cleaning apparatus is configured in a second configuration.

As but another illustrative example, a particular embodiment of the cleaning apparatus (1) can be configured such that an uppermost panel peripheral edge (18) aligns with an uppermost flexible body peripheral edge (10) (as shown in FIG. 5A and FIG. 6A).

As but yet another illustrative example, a particular embodiment of the cleaning apparatus (1) can be configured such that a bottommost panel peripheral edge (18) aligns with a bottommost flexible body peripheral edge (10) and further, a sidemost panel peripheral edge (18) aligns with a sidemost flexible body peripheral edge (10) (as shown in FIG. 2A, FIG. 5A, FIG. 6A, FIG. 8A, and FIG. 9A).

Figure 10A:
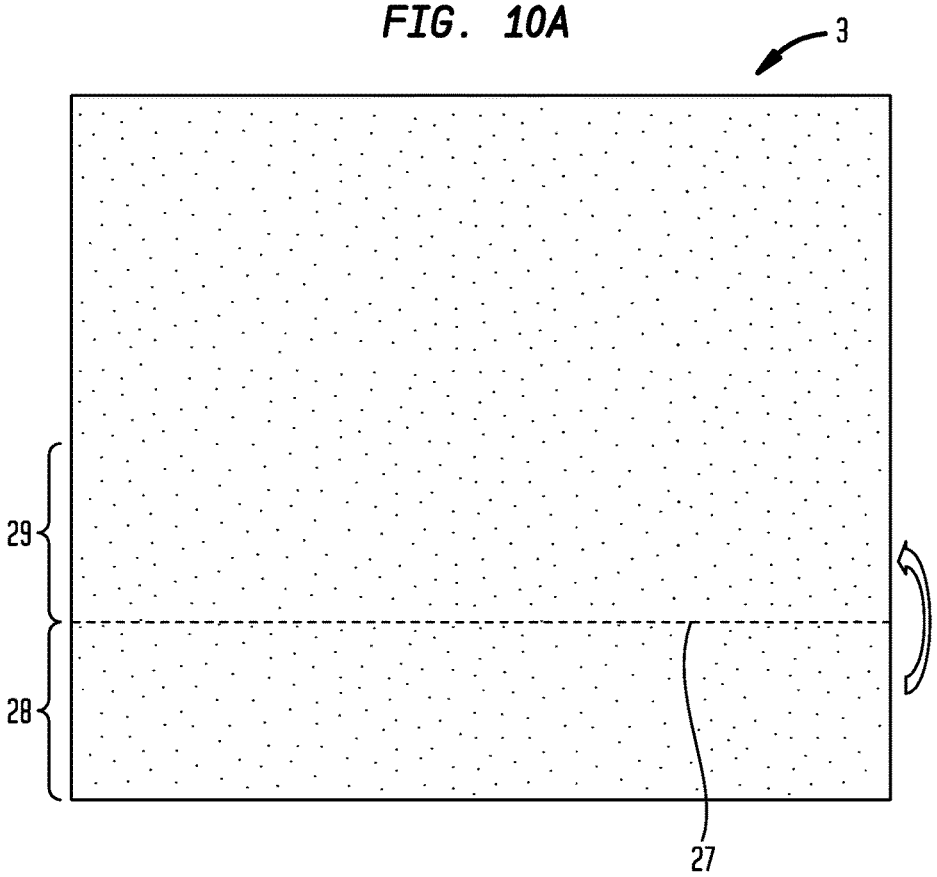
FIG. 10A is an illustration of a front view of a method of making a particular embodiment of the cleaning apparatus, whereby the flexible body and the panel are formed as a one-piece construct.
Figure 10B:
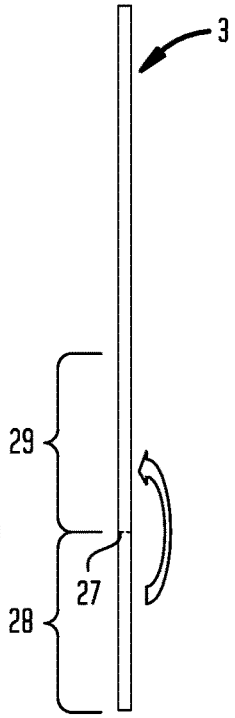
FIG. 10B is an illustration of a side view corresponding to FIG. 10A.
Figure 10C:
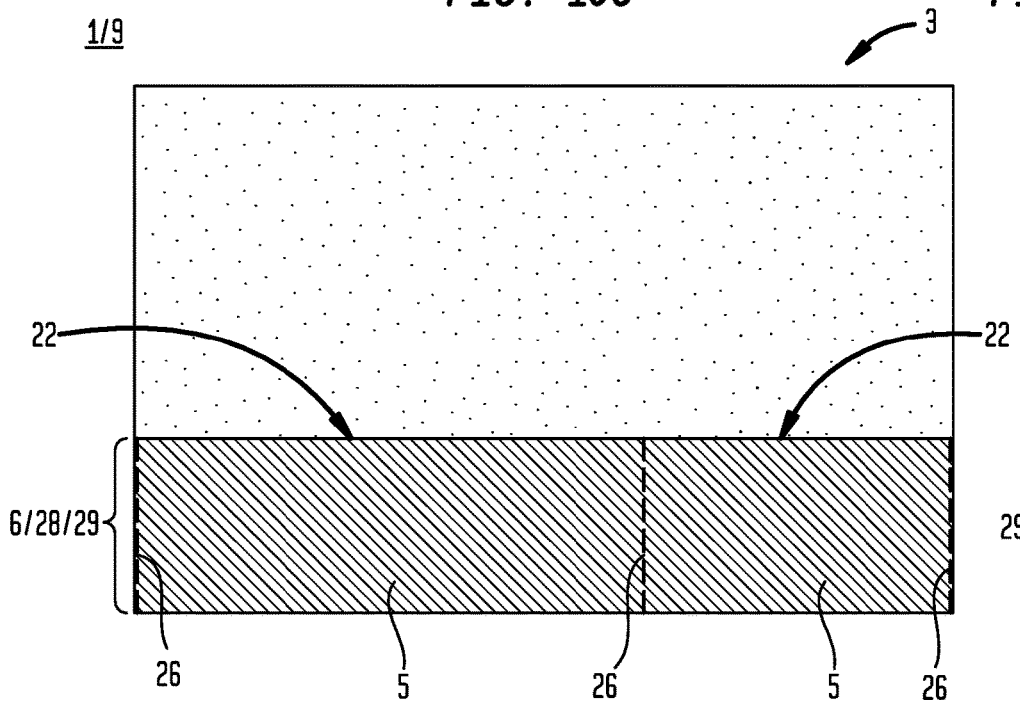
FIG. 10C is an illustration of a front view of a method of making a particular embodiment of the cleaning apparatus, whereby the flexible body and the panel are formed as a one-piece construct.
Figure 10D:
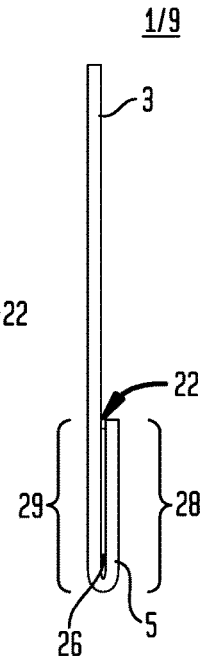
FIG. 10D is an illustration of a side view corresponding to FIG. 10C.

Now referring primarily to FIG. 10A through FIG. 10D, as to particular embodiments, the flexible body (3) and the panel (5) can be formed as a one-piece construct, whereby a portion of the flexible body (3) provides the panel (5). Consequently, the receptacle (6) can be generated by folding the flexible body (3) along a first fold line (27) (as shown in the examples of FIG. 10A and FIG. 10B) such that a flexible body first section (28) overlays a flexible body second section (29), whereby the flexible body first section (28) ultimately provides the panel (5). Subsequently, portions of the panel (5) and the flexible body second section (29) can be fixedly coupled, except proximate the receptacle opening (22), to define the receptacle interior space (23) therebetween.

Figure 5H:
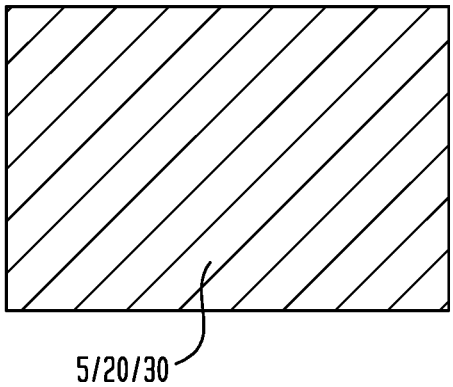
FIG. 5H is a view of a second exposed cleaning surface of the particular embodiment of the cleaning apparatus shown in FIG. 5A through FIG. 5F, whereby the cleaning apparatus is configured in a first configuration.
Figure 5I:
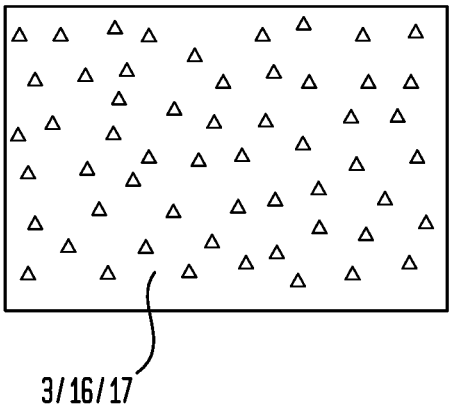
FIG. 5I is a view of a first exposed cleaning surface of the particular embodiment of the cleaning apparatus shown in FIG. 5A through FIG. 5F, whereby the cleaning apparatus is configured in a first configuration.
Figure 5J:
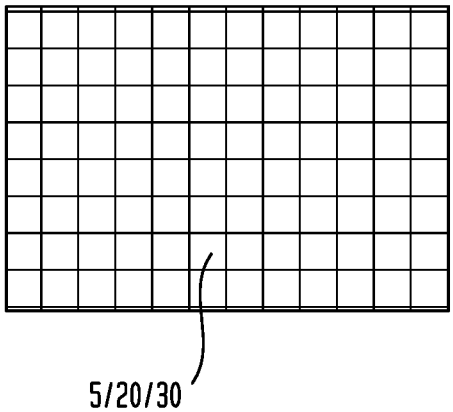
FIG. 5J is a view of a second exposed cleaning surface of the particular embodiment of the cleaning apparatus shown in FIG. 5A through FIG. 5F, whereby the cleaning apparatus is configured in a first configuration.

Of note, as shown in the examples of FIG. 5H and FIG. 5J, when the cleaning apparatus (1) is disposed in the first configuration (8), while the first exposed cleaning surface (17) can be provided by one of the flexible body first or second layers (15)(16), the panel second face (20) can provide a second exposed cleaning surface (30). As to particular embodiments, the second exposed cleaning surface (30) can have an abrasiveness which is similar to that of the first exposed cleaning surface (17). As to other particular embodiments, the second exposed cleaning surface (30) can have an abrasiveness which differs from that of the first exposed cleaning surface (17).

Now referring primarily to FIG. 5A through FIG. 6B, the cleaning apparatus (1) can, but need not necessarily, further include a plurality of panels (5), whether discrete or formed from the flexible body (3), coupled to the flexible body (3) to form a corresponding plurality of receptacles (6), whereby each receptacle (6) is configured to receive the flexible body collapsible portion (4) when the flexible body collapsible portion (4) disposes in the collapsed condition (7).

Figure 6B:
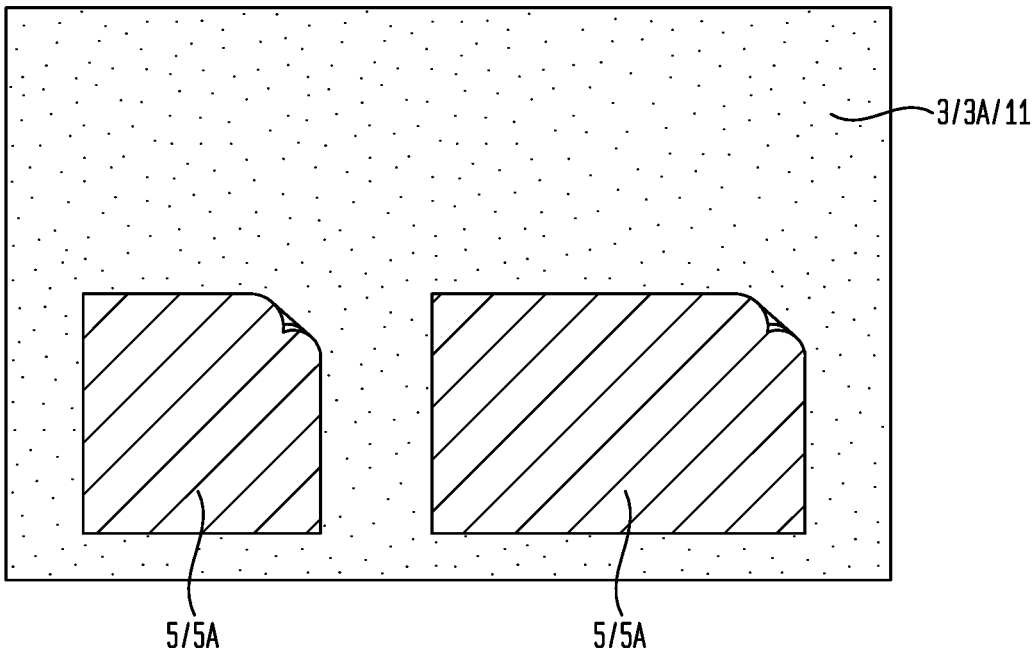
FIG. 6B is a front view of a particular embodiment of the cleaning apparatus having a plurality of panels coupled to a flexible body first face of a flexible body, whereby the cleaning apparatus is configured in a second configuration.
Figure 7E:
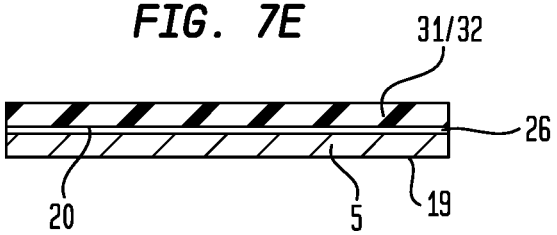
FIG. 7E is a first end view of the particular embodiment of a panel shown in FIG. 7A.
Figure 7A:
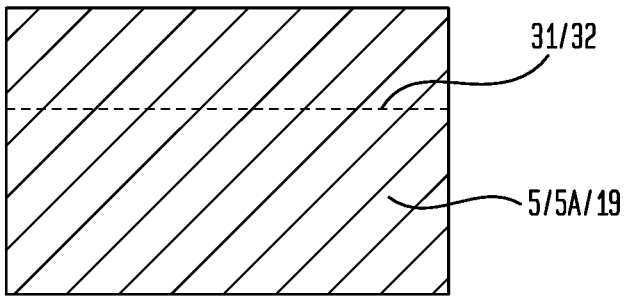
FIG. 7A is a front view of a particular embodiment of a panel of the cleaning apparatus, whereby a retaining flap is fixedly coupled to an upper portion of the panel.
Figure 7C:
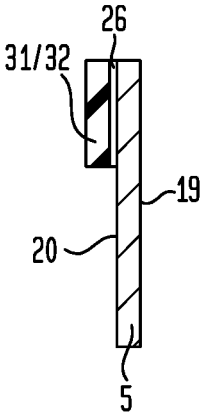
FIG. 7C is a first side view of the particular embodiment of a panel shown in FIG. 7A.
Figure 7B:
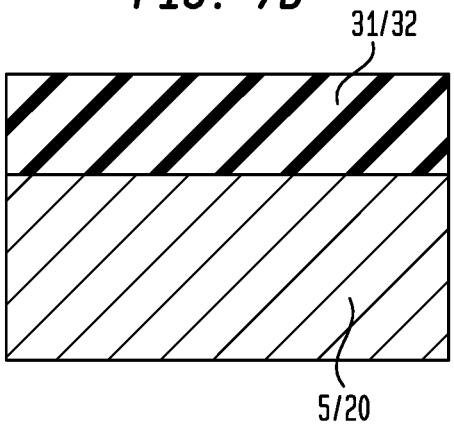
FIG. 7B is a rear view of the particular embodiment of a panel shown in FIG. 7A.
Figure 7D:
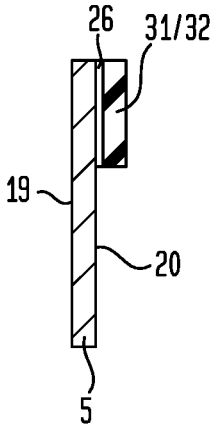
FIG. 7D is a second side view of the particular embodiment of a panel shown in FIG. 7A.
Figure 7F:
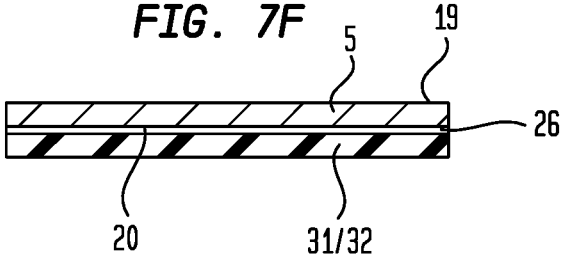
FIG. 7F is a second end view of the particular embodiment of a panel shown in FIG. 7A.

Now referring primarily to FIG. 6A and FIG. 6B, as to particular embodiments of the cleaning apparatus (1), a plurality of panels (5) can be coupled to the flexible body first or second face (11)(12), for example in adjacent relation or in spaced apart relation.

Now referring primarily to FIG. 6A, as but one illustrative example, at least one of the plurality of panels (5) can be coupled to the flexible body (3) proximate the flexible body peripheral edge (10) and, as to particular embodiments, a portion of the panel peripheral edge (18) can align with a portion of the flexible body peripheral edge (10).

Again referring primarily to FIG. 6A, as but another illustrative example, each of the plurality of panels (5) can be coupled to the flexible body (3) proximate the flexible body peripheral edge (10). As to particular embodiments, each of the plurality of panels (5) can have a portion of its panel peripheral edge (18) aligned with a portion of the flexible body peripheral edge (10).

Now referring primarily to FIG. 6B, as but another illustrative example, at least one or each of a plurality of panels (5) can be coupled to the flexible body (3) distal from the flexible body peripheral edge (10).

Now referring primarily to FIG. 5A through FIG. 5J, as to particular embodiments of the cleaning apparatus (1) having a plurality of panels (5), at least one panel (5) can be coupled to the flexible body first face (11) and at least one panel (5) can be coupled to the flexible body second face (12).

Again referring primarily to FIG. 5A through FIG. 5J, as to a particular embodiment of the cleaning apparatus (1) having a flexible body (3) formed from flexible body first and second layers (15)(16) and having one panel (5) coupled to each of the flexible body first and second layers (15)(16), which provide the corresponding flexible body first and second faces (11)(12), each of the flexible body first and second layers (15)(16) and each of the two panels (5) can have a unique abrasive property, providing two options for the first exposed cleaning surface (17) (as shown in the examples of FIG. 5G and FIG. 5I) and two options for the second exposed cleaning surface (30) (as shown in the examples of FIG. 5H and FIG. 5J) when the first configuration (8) is generated. As such, the cleaning apparatus (1) can be customized, whereby the exposed cleaning surfaces (17)(30) can be selected from one of four options, depending upon the abrasiveness desired to clean a particular cleanable surface (2). As to particular embodiments, the exposed cleaning surfaces (17)(30) can be flexible exposed cleaning surfaces (17)(30), which may be useful for conforming to the cleanable surface (2) to better clean the cleanable surface (2) versus rigid or non-flexible exposed cleaning surfaces (17)(30).

The cleaning apparatus (1) can, but need not necessarily, further include a retention element (31) configured to retain the cleaning apparatus (1) in the first configuration (8). As but one illustrative example, the retention element (31) can be configured as a retaining flap (32) coupled to the flexible body (3) or the panel (5) proximate the receptacle opening (22) of the receptacle (6). As to particular embodiments having the latter configuration, the retaining flap (32) can be fixedly coupled to an upper portion of the panel (5) (as shown in the examples of FIG. 7A through FIG. 7F).

As to particular embodiments, the retaining flap (32) can be fixedly coupled to the upper portion of the panel (5) by an adherent layer (26), as described above.

As to other particular embodiments, the panel (5) and the retaining flap (32) can be formed as a one-piece construct, whereby a portion of the panel (5) provides the retaining flap (32).

Figure 11A:
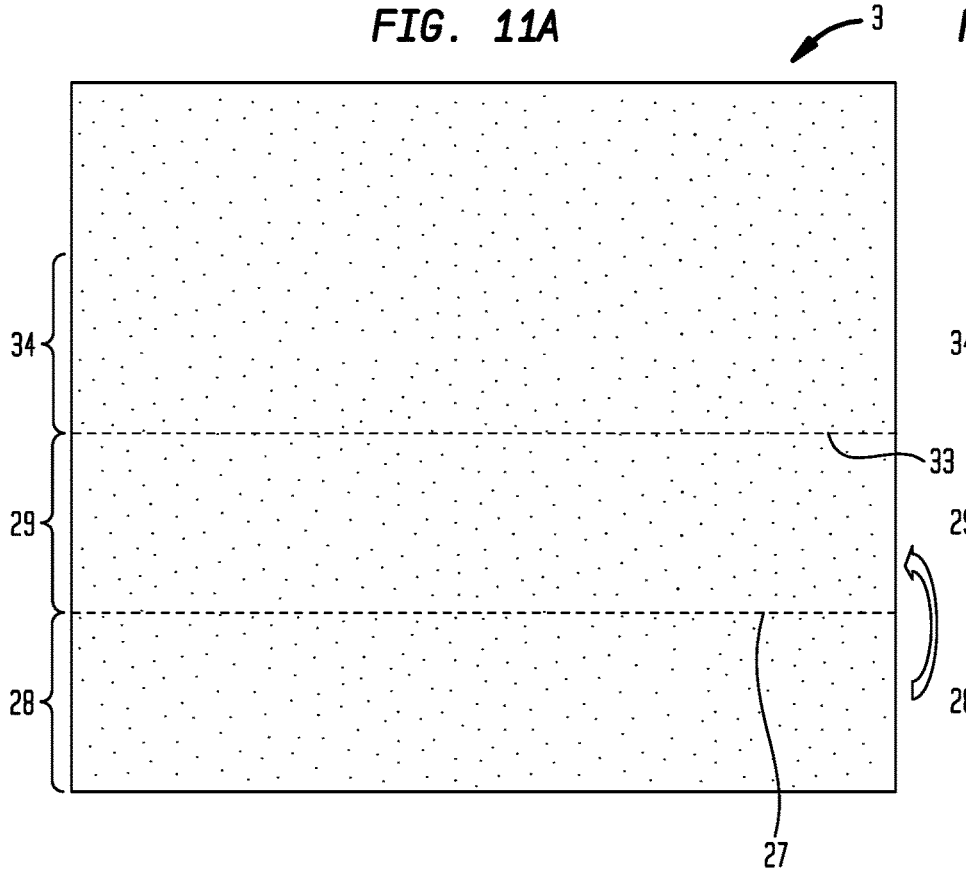
FIG. 11A is an illustration of a front view of a method of making a particular embodiment of the cleaning apparatus, whereby the flexible body, the panel, and the retaining flap are formed as a one-piece construct.
Figure 11B:
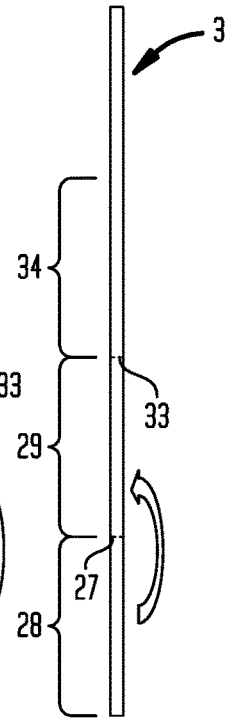
FIG. 11B is an illustration of a side view corresponding to FIG. 11A.
Figure 11C:
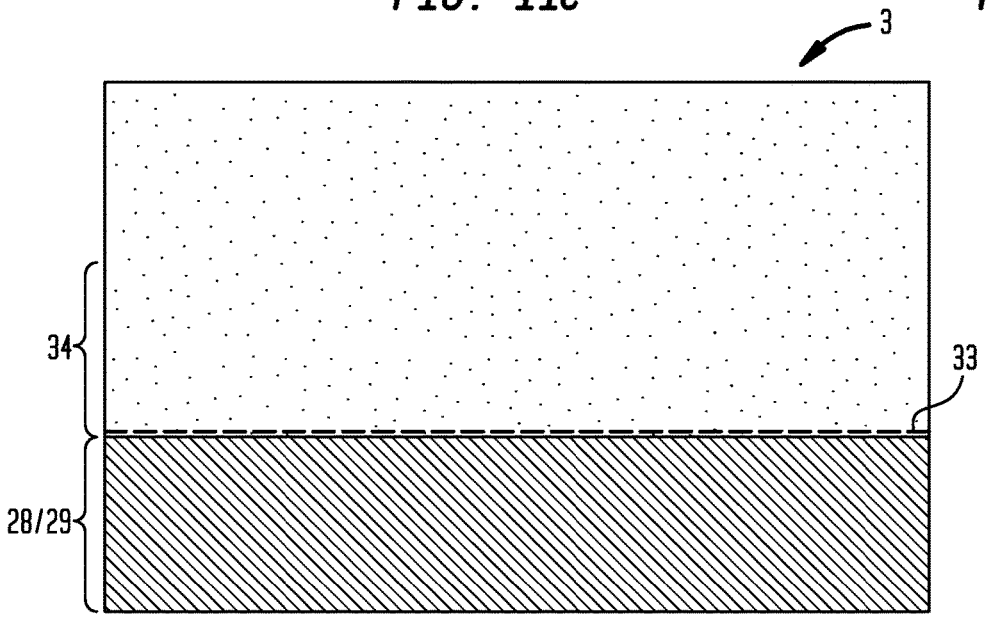
FIG. 11C is an illustration of a front view of a method of making a particular embodiment of the cleaning apparatus, whereby the flexible body, the panel, and the retaining flap are formed as a one-piece construct.
Figure 11D:
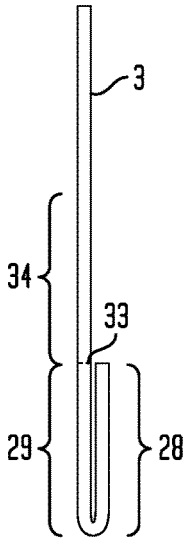
FIG. 11D is an illustration of a side view corresponding to FIG. 11C.
Figure 11E:
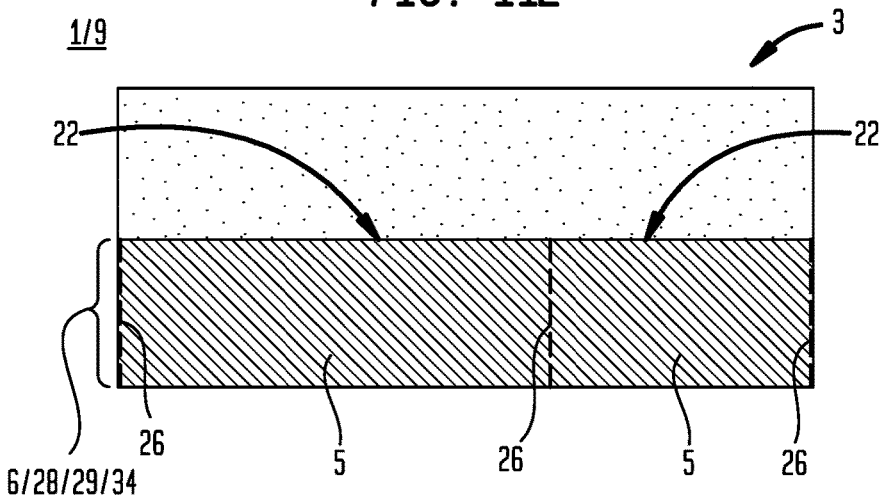
FIG. 11E is an illustration of a front view of a method of making a particular embodiment of the cleaning apparatus, whereby the flexible body, the panel, and the retaining flap are formed as a one-piece construct.
Figure 11F:
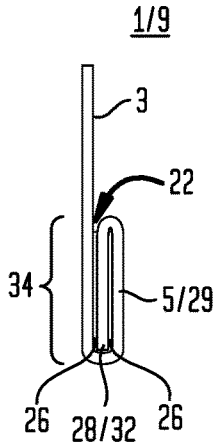
FIG. 11F is an illustration of a side view corresponding to FIG. 11E.

Now referring primarily to FIG. 11A through FIG. 11F, as to particular embodiments, the flexible body (3), the panel (5), and the retaining flap (32) can be formed as a one-piece construct, whereby a portion of the flexible body (3) provides both the panel (5) and the retaining flap (32). Consequently, the retaining flap (32) can be generated by folding the flexible body (3) along a first fold line (27) (as shown in the examples of FIG. 11A and FIG. 11B) such that a flexible body first section (28) overlays a flexible body second section (29), whereby the flexible body first section (28) ultimately provides the retaining flap (32). Following, the panel (5) can be generated by folding the flexible body (3) along a second fold line (33) (as shown in the examples of FIG. 11C and FIG. 11D) such that the flexible body first and second sections (28)(29) overlay a flexible body third section (34), whereby the flexible body second section (29) ultimately provides the panel (5). Subsequently, portions of the panel (5), the retaining flap (32), and the flexible body third section (34) can be fixedly coupled, except proximate the receptacle opening (22), to define the receptacle interior space (23) therebetween. In this configuration, the retaining flap (32) provided by the flexible body first section (28) disposes between the flexible body (3) and the panel (5) when the cleaning apparatus (1) disposes in the second configuration (9).

A method of making a cleaning apparatus (1) having an adjustable exposed surface area includes providing a flexible body (3) with a predetermined flexible body area (3A), the flexible body (3) having a flexible body collapsible portion (4); and providing a panel (5) with a predetermined panel area (5A) which is lesser than the predetermined flexible body area (3A); coupling the panel (5) to the flexible body (3) to form a receptacle (6) sized to receive the flexible body collapsible portion (4) when the flexible body collapsible portion (4) disposes in a collapsed condition (7); whereby the cleaning apparatus (1) is adjustable between a first configuration (8), in which the cleaning apparatus (1) has a lesser exposed surface area, and a second configuration (9), in which the cleaning apparatus (1) has a greater exposed surface area; and whereby the first configuration (8) is generated by removably inserting the flexible body collapsible portion (4) disposed in the collapsed condition (7) into the receptacle (6).

The method of making the cleaning apparatus (1) can further include providing additional components of the cleaning apparatus (1) as described above and as described in the claims.

The flexible body (3), the flexible body layers (15)(16) (which as to particular embodiments, can be coupled, directly coupled, or connected to one another to provide the flexible body (3)), the panel (5), and the retaining flap (32) can be made from any of a numerous and wide variety of materials, including flexible materials, and including materials capable of absorbing and retaining fluids. By way of non-limiting examples, the material can be natural, synthetic, soft, rough, non-abrasive, abrasive, antimicrobial, antibacterial, odor-resistant, machine washable, or combinations thereof, and can include or consist of woven fabric, cheesecloth, cotton, chamois leather, denim, gauze, leather, linen, mesh, metal, plastic, polyester, rayon, satin, sponge, suede, vinyl, wool, or the like, or combinations thereof, or any material capable of cleaning a cleanable surface (2).

As but one non-limiting example of a particular embodiments of the cleaning apparatus (1) comprising a flexible body (3) formed from a plurality of flexible body layers (15)(16) coupled to one another in overlaying engagement, the flexible body first layer (15) can be formed from a first mesh antimicrobial material having a first pore size and the flexible body second layer (16) can be formed from a second mesh antimicrobial material having a second pore size, whereby the first pore size can be lesser than the second pore size. Additionally, the first mesh material can have a lesser abrasiveness in relation to the second mesh material.

As described above, a method of using the cleaning apparatus (1) includes disposing the flexible body collapsible portion (4) in the collapsed condition (7); and removably inserting the flexible body collapsible portion (4) disposed in the collapsed condition (7) into the receptacle (6) to generate the first configuration (8), in which the cleaning apparatus (1) has a lesser exposed surface area relative to the second configuration (9), in which the cleaning apparatus (1) has a greater exposed surface area.

Figure 8A:
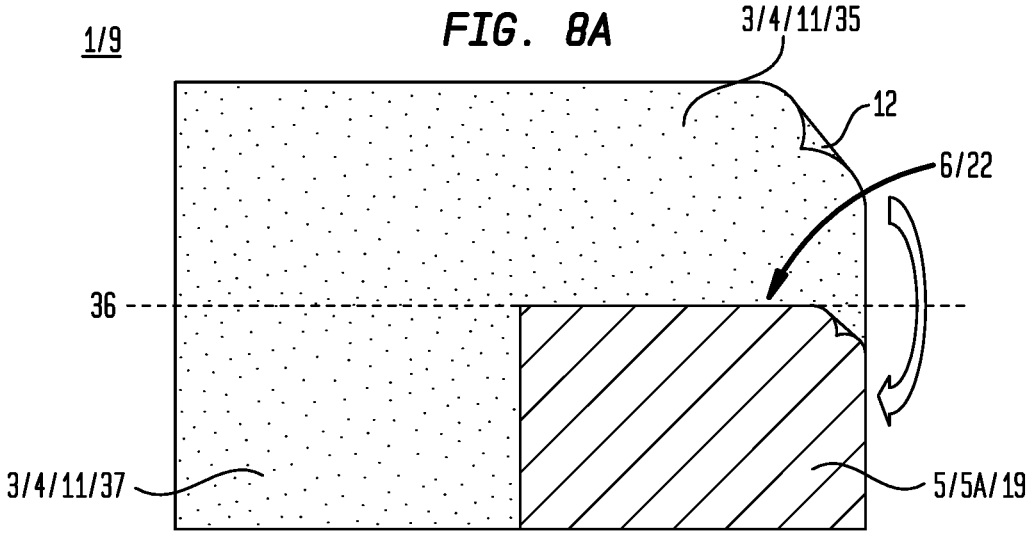
FIG. 8A is an illustration of a method of generating a first configuration of the cleaning apparatus.
Figure 8B:
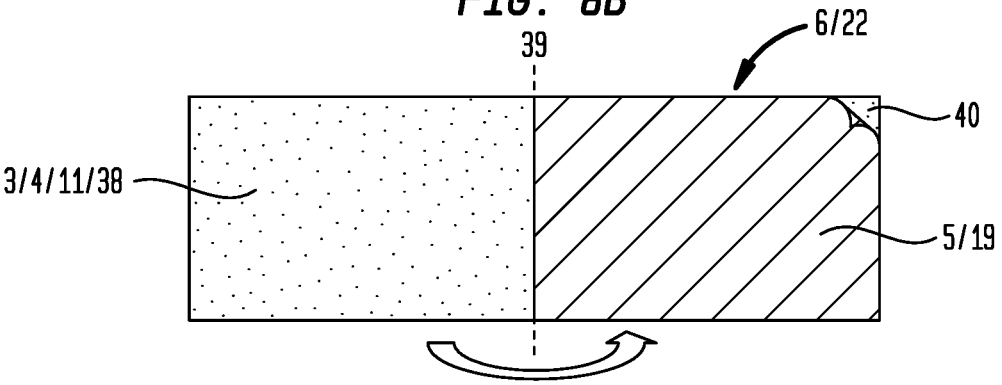
FIG. 8B is an illustration of a method of generating a first configuration of the cleaning apparatus.
Figure 8C:
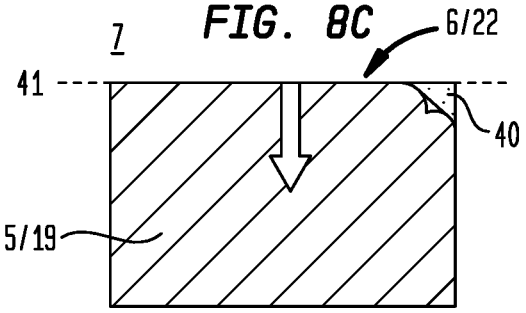
FIG. 8C is an illustration of a method of generating a first configuration of the cleaning apparatus.

Now referring primarily to FIG. 8A through FIG. 8C, as to particular embodiments, disposing the flexible body collapsible portion (4) in the collapsed condition (7) can be achieved by serially folding the flexible body collapsible portion (4), although the invention need not be limited to folding.

As a first step, a flexible body collapsible first portion (35) can be folded about a first folding axis (36) (as shown in the example of FIG. 8A), disposing the flexible body collapsible first portion (35) adjacent a flexible body collapsible second portion (37) to provide a flexible body collapsible third portion (38) (as shown in the example of FIG. 8B).

As a second step, the flexible body collapsible third portion (38) can be folded about a second folding axis (39) (as shown in the example of FIG. 8B), disposing the flexible body collapsible third portion (38) adjacent a flexible body portion (40) which, together with the panel (5), defines the receptacle (6) (as shown in the example of FIG. 8C). As such, the flexible body collapsible portion (4) is disposed in the collapsed condition (7).

Figure 8D:
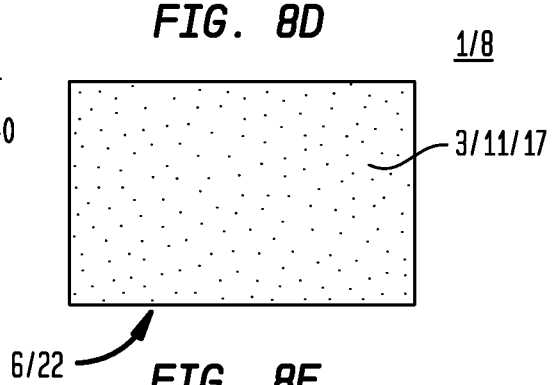
FIG. 8D is an illustration of a first exposed cleaning surface, which can be provided following the method of generating the first configuration of the cleaning apparatus shown in FIG. 8A through FIG. 8C.
Figure 8E:
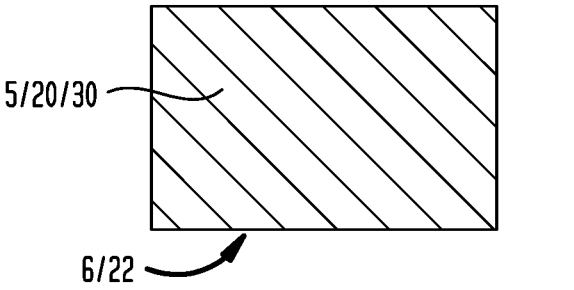
FIG. 8E is an illustration of a second exposed cleaning surface, which can be provided following the method of generating the first configuration of the cleaning apparatus shown in FIG. 8A through FIG. 8C.

Now referring primarily to FIG. 8C through FIG. 8E, as to particular embodiments, removably inserting the flexible body collapsible portion (4) disposed in the collapsed condition (7) into the receptacle (6) can be achieved by inversion, although the invention need not be limited to inversion.

As a third step, the flexible body collapsible third portion (38) adjacent the flexible body portion (40) and the panel (5) can be inverted about a first inversion axis (41) to generate the first configuration (8) of the cleaning apparatus (1) (as shown in the example of FIG. 8C), providing first and second exposed cleaning surfaces (17)(30) (as shown in the examples of FIG. 8D and FIG. 8E), which may be useful for cleaning a cleanable surface (2).

Now referring primarily to FIG. 9A through FIG. 9F, a method of using a cleaning apparatus (1) having a retaining flap (32) fixedly coupled to the upper portion of the panel (5) can include disposing the retaining flap (32) over the receptacle opening (22) to preclude the flexible body collapsible portion (4) received within the receptacle interior space (23) from outwardly egressing.

Figure 9A:
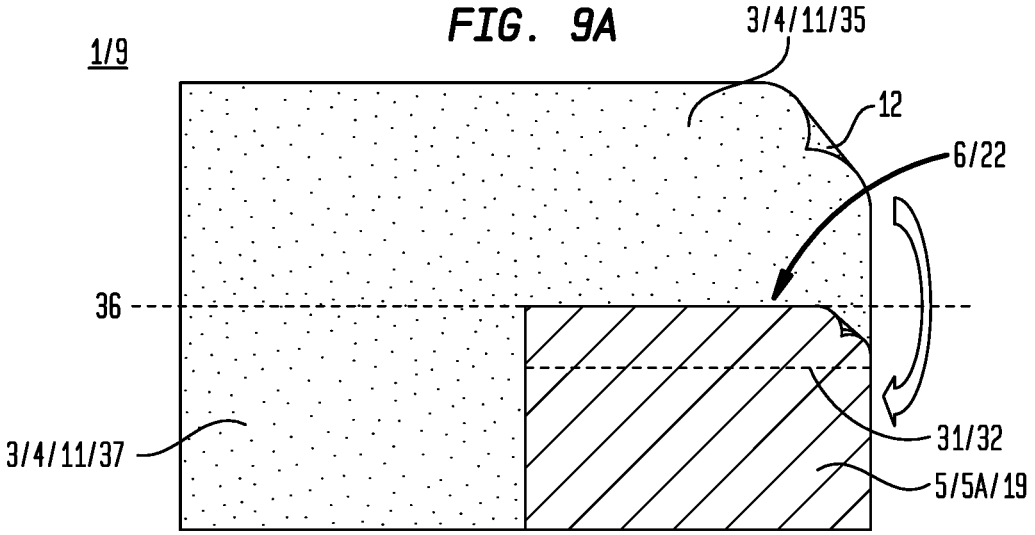
FIG. 9A is an illustration of a method of generating a first configuration of the cleaning apparatus.
Figure 9B:
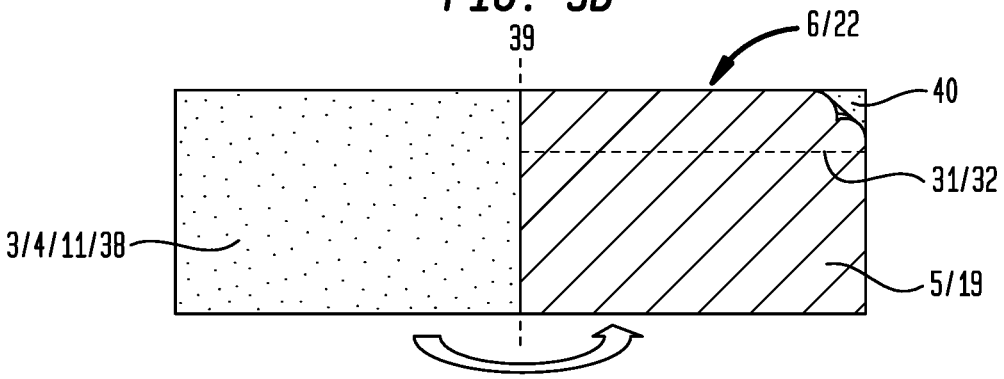
FIG. 9B is an illustration of a method of generating a first configuration of the cleaning apparatus.
Figure 9C:
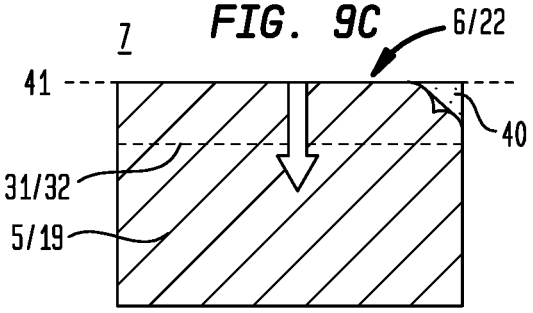
FIG. 9C is an illustration of a method of generating a first configuration of the cleaning apparatus.
Figure 9E:
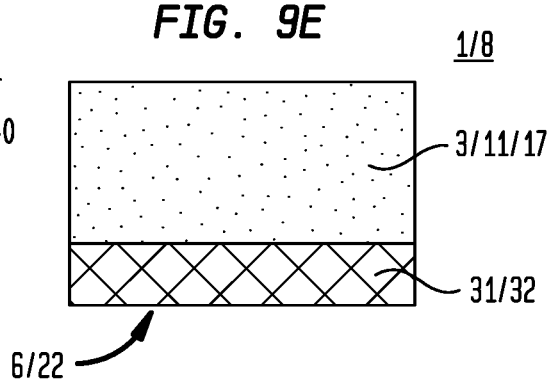
FIG. 9E is an illustration of a first exposed cleaning surface, which can be provided following the method of generating the first configuration of the cleaning apparatus shown in FIG. 9A through FIG. 9D.
Figure 9D:
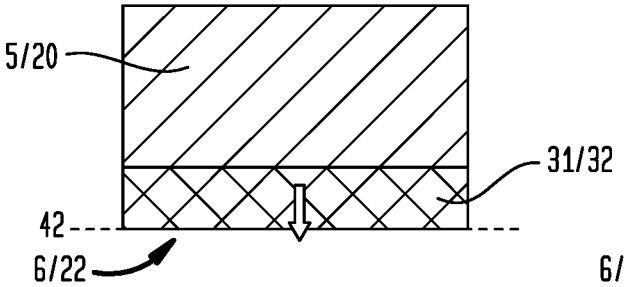
FIG. 9D is an illustration of a method of generating a first configuration of the cleaning apparatus.
Figure 9F:
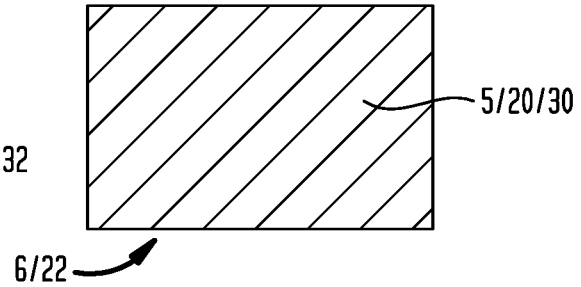
FIG. 9F is an illustration of a second exposed cleaning surface, which can be provided following the method of generating the first configuration of the cleaning apparatus shown in FIG. 9A through FIG. 9D.

As but one illustrative example, the retaining flap (32) can be inverted about a second inversion axis (42) to overlay the receptacle opening (22) (as shown in the example of FIG. 9D), thereby facilitating retention of the flexible body collapsible portion (4) within the receptacle interior space (23). Following, the cleaning apparatus (1) configured in the first configuration (8) can be used to clean a cleanable surface (2).

Again as described above, the method of using the cleaning apparatus (1) can, but need not necessarily, further include removing the flexible body collapsible portion (4) from within the receptacle (6) to generate the second configuration (9), in which the cleaning apparatus (1) has a greater exposed surface area, whereby the second configuration (9) of the cleaning apparatus (1) may be useful to facilitate washing or drying of the cleaning apparatus (1).

As can be easily understood from the foregoing, the basic concepts of the present invention may be embodied in a variety of ways. The invention involves numerous and varied embodiments of a cleaning apparatus having an adjustable exposed surface area and methods for making and using such a cleaning apparatus, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "cleaner" should be understood to encompass disclosure of the act of "cleaning"—whether explicitly discussed or not—and, conversely, were there effectively disclosure of the act of "cleaning", such a disclosure should be understood to encompass disclosure of a "cleaner" and even a "means for cleaning". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Additionally, all directional references (e.g., proximal, distal, upper, lower, upward, downward, left, right, lateral, front, rear, back, top, bottom, above, below, vertical, horizontal, clockwise, and counterclockwise) are only used for identification purposes to aid the reader's understanding of the present invention, and do not create limitations, particularly as to the position, orientation, or use of the invention.

Thus, the applicant(s) should be understood to claim at least: i) each of the cleaning apparatuses having adjustable exposed surface areas herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A method of cleaning with a cleaning product having an adjustable exposed surface area, comprising:

obtaining said cleaning product comprising:

a flexible body with a predetermined flexible body area, said flexible body having a flexible body collapsible portion;

wherein said flexible body comprises (i) a flexible body first face formed from a flexible body first layer and (ii) a flexible body second face formed from a flexible body second layer; and wherein said flexible body first layer has a lesser abrasiveness in relation to said flexible body second layer; and disposing said flexible body collapsible portion in a collapsed condition;

removably inserting said flexible body collapsible portion disposed in said collapsed condition into a receptacle formed by a panel sewn to said flexible body to generate a first configuration in which said cleaning product has a lesser exposed surface area relative to a second configuration;

outwardly exposing said flexible body first layer when generating said first configuration to provide an exposed cleaning surface with said lesser abrasiveness;

cleaning a surface by contacting a surface with the outwardly exposed flexible body first layer while the cleaning product is in said first configuration;

removably inserting said flexible body collapsible portion disposed in a collapsed condition into a receptacle formed by a panel sewn to said flexible body to outwardly expose said flexible body second layer; and cleaning a surface by contacting a surface with the outwardly exposed flexible body second layer.

2. The method of claim 1, further comprising removing said flexible body collapsible portion from within a receptacle to generate said second configuration.

3. The method of claim 2, further comprising cleaning with said cleaning product configured in said second configuration.

4. The method of claim 2, further comprising washing said cleaning product.

5. The method of claim 4, further comprising hand-washing said cleaning product.

6. The method of claim 4, further comprising washing said cleaning product via a washing machine.

7. The method of claim 2, further comprising drying said cleaning product.

8. The method of claim 7, further comprising air-drying said cleaning product.

9. The method of claim 7, further comprising drying said cleaning product via a clothes dryer.

10. The method of claim 7, further comprising re-using said cleaning product.

11. The method of claim 1, wherein said flexible body and a panel are formed as a one-piece construct.

12. The method of claim 11, wherein a receptacle is generated by folding said flexible body along a fold axis to overlay a portion of said flexible body first face with a portion of said flexible body second face to define a receptacle interior space therebetween.

13. The method of claim 1, wherein the product comprises a plurality of panels coupled to said flexible body to form a corresponding plurality of receptacles, each said receptacle configured to receive said flexibly body collapsible portion.

14. The method of claim 13, wherein at least one of said plurality of said panels is coupled to said flexible body first face and at least one of said plurality of panels is coupled to said flexible body second face.

15. The method of claim 1, further comprising a retention element configured to retain said cleaning product in said first configuration.

16. The method of claim 15, wherein said retention element comprises a retaining flap coupled to a panel proximate a receptacle opening of a receptacle.

17. The method of claim 16, wherein said flexible body, a panel, and a retaining flap are formed as a one-piece construct.

* * * * *